US012799939B2

(12) United States Patent
Khongkraphan et al.

(10) Patent No.: US 12,799,939 B2
(45) Date of Patent: Nov. 17, 2026

(54) SCROLL COMPRESSOR

(71) Applicant: MITSUBUSHI ELECTRIC SIAM COMPRESSOR INDUSTRY COMPANY LIMITED, Tungsukhla (TH)

(72) Inventors: Siwathep Khongkraphan, Tungsukhla (TH); Jetsada Meeruang, Tungsukhla (TH)

(73) Assignee: MITSUBUSHI ELECTRIC SIAM COMPRESSOR INDUSTRY COMPANY LIMITED, Tungsukhla (TH)

( * ) Notice: Subject to any disclaimer, the term of this patent is extended or adjusted under 35 U.S.C. 154(b) by 109 days.

(21) Appl. No.: 18/851,540

(22) PCT Filed: Jul. 10, 2023

(86) PCT No.: PCT/IB2023/057051
§ 371 (c)(1),
(2) Date: Sep. 26, 2024

(87) PCT Pub. No.: WO2025/012676
PCT Pub. Date: Jan. 16, 2025

(65) Prior Publication Data

US 2026/0168493 A1 Jun. 18, 2026

(51) Int. Cl.
*F04C 18/02* (2006.01)
*F04C 29/00* (2006.01)
*F04C 29/12* (2006.01)

(52) U.S. Cl.
CPC ..... *F04C 18/0215* (2013.01); *F04C 29/0057* (2013.01); *F04C 29/12* (2013.01); *F04C 2240/30* (2013.01)

(58) Field of Classification Search
CPC .. F04C 18/0215; F04C 29/0057; F04C 29/12; F04C 2240/30
See application file for complete search history.

(56) References Cited

U.S. PATENT DOCUMENTS

2002/0071780 A1* 6/2002 Chang ..... F04C 18/0269 418/55.2
2013/0216416 A1* 8/2013 Takeda ..... F04C 18/0215 418/55.1

FOREIGN PATENT DOCUMENTS

JP H09-264273 A 10/1997
JP 2007-315172 A 12/2007
(Continued)

OTHER PUBLICATIONS

International Search Report of the International Searching Authority mailed Jan. 8, 2024 in corresponding International Patent Application No. PCT/IB2023/057051.
(Continued)

*Primary Examiner* — Anthony Ayala Delgado
(74) *Attorney, Agent, or Firm* — Posz Law Group, PLC

(57) ABSTRACT

The present invention discloses a scroll compressor comprising: a fixed scroll, and an orbiting scroll. The orbiting scroll orbits while the first orbiting scroll outer arc contacts with the second fixed scroll inner arc, and then, when the first orbiting scroll outer arc is not brought into contact with a connection point between the second fixed scroll inner arc and the third fixed scroll inner arc, the first compression chamber communicates with the discharge port.

8 Claims, 4 Drawing Sheets

(56) References Cited

FOREIGN PATENT DOCUMENTS

| | | | |
|---|---|---|---|
| JP | 2009-228470 | A | 10/2009 |
| JP | 2009-250200 | A | 10/2009 |
| WO | 2006/019010 | A1 | 2/2006 |

OTHER PUBLICATIONS

Written Opinion of the International Searching Authority issued Jan. 8, 2024 in corresponding International Patent Application No. PCT/IB2023/057051.

Office Action dated Dec. 9, 2025 issued in corresponding Japanese Patent Application No. 2024-558271 (and English machine translation).

* cited by examiner

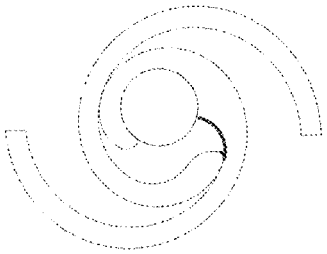
FIG. 4A 0 deg
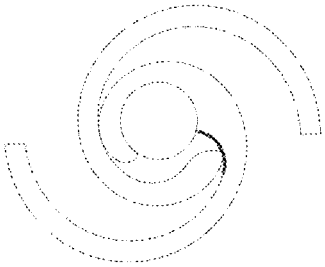
FIG. 4B 30 deg
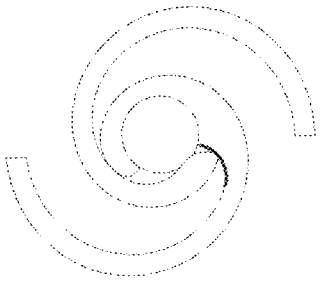
FIG. 4C 60 deg
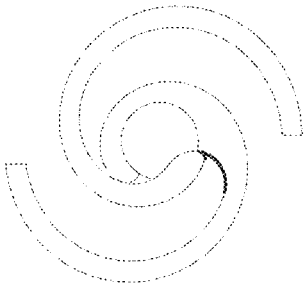
FIG. 4D 90 deg
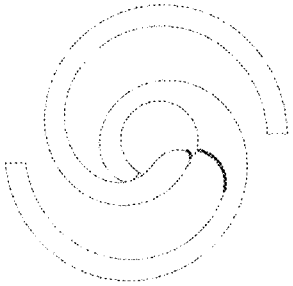
FIG. 4E 120 deg
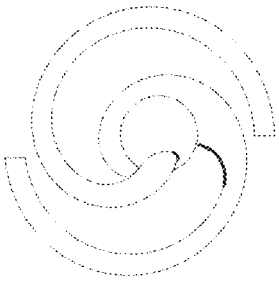
FIG. 4F 150 deg
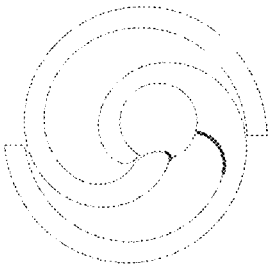
FIG. 4G 180 deg
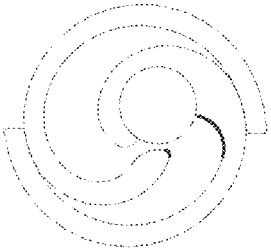
FIG. 4H 210 deg
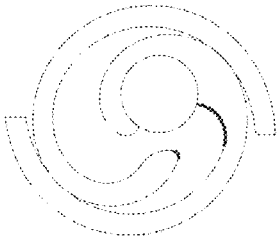
FIG. 4I 240deg
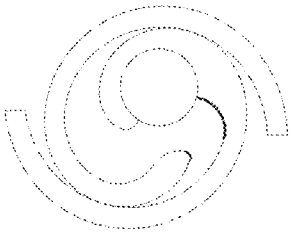
FIG. 4J 270deg
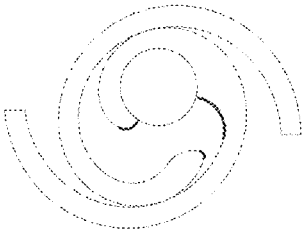
FIG. 4K 300 deg
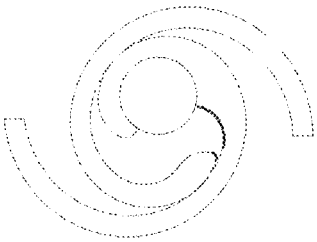
FIG. 4L 330 deg

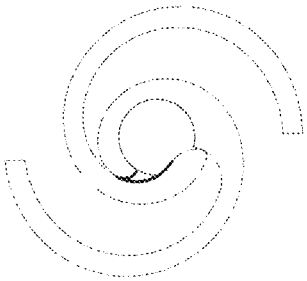
FIG. 5A 0 deg
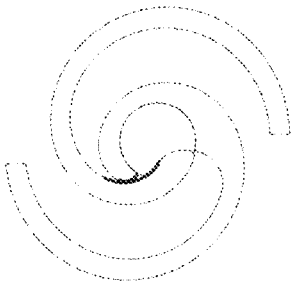
FIG. 5B 30 deg
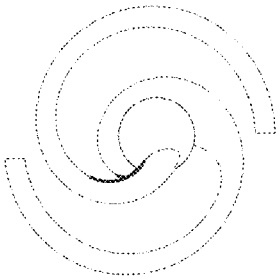
FIG. 5C 60 deg
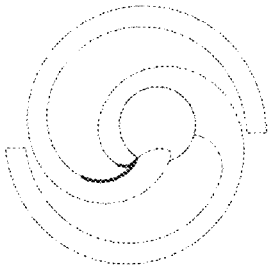
FIG. 5D 90 deg
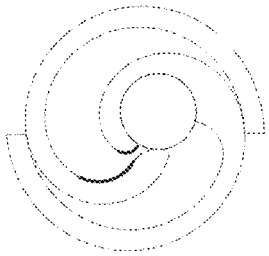
FIG. 5E 120 deg
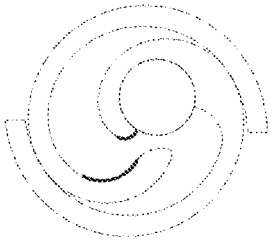
FIG. 5F 150 deg
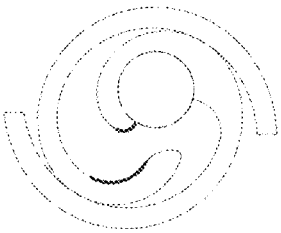
FIG. 5G 180 deg
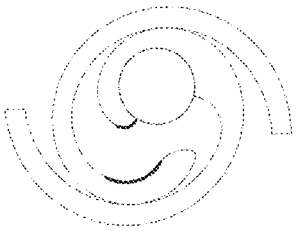
FIG. 5H 210 deg
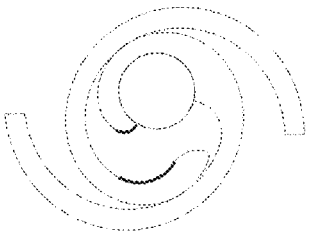
FIG. 5I 240deg
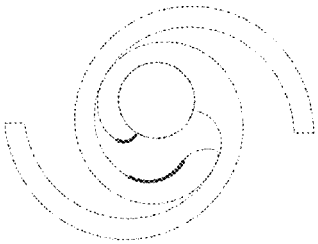
FIG. 5J 270deg
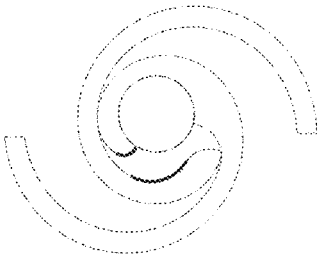
FIG. 5K 300 deg
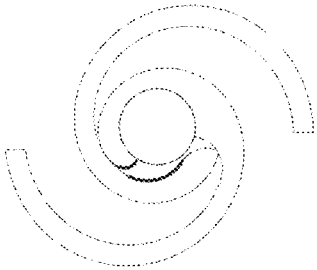
FIG. 5L 330 deg

SCROLL COMPRESSOR

CROSS REFERENCE TO RELATED APPLICATION

This application is a U.S. national stage application of PCT/IB2023/057051 filed on Jul. 10, 2023, the contents of which are incorporated herein by reference.

FIELD OF INVENTION

The present invention relates to a scroll compressor.

BACKGROUND OF THE INVENTION

A scroll compressor which includes a sealed container, a suction pipe in which gas refrigerant sucked from outside flows into the scroll compressor, and a scroll compression element including a fixed scroll and an orbiting scroll configured to be engaged with the fixed scroll to form a compression chamber between the fixed scroll and the orbiting scroll, is known as disclosed in Japanese laid-open publication No. JP2007-315172A hereinafter called PTL1.

In PTL1, at the winding start portions of the spiral wraps of the fixed scroll and the orbiting scroll, a first outer arc in which the head of the spiral wrap smoothly connects to the winding start point of the outer wall involute curve, connects with a second inner arc in which the head of the spiral wrap smoothly contacts the winding start point of the inner wall involute curve.

Moreover, the first outer arc and the second inner arc of the fixed scroll are connected by a third inner arc that does not smoothly connect with the respective arcs.

To discharge the compressed gas refrigerant from a discharge port, when the compression chamber communicates with the discharge port, the head of the orbiting scroll moves along the second inner arc of the fixed scroll toward the third inner arc of the fixed scroll.

However, since a narrow gap is formed between the head of the orbiting scroll and the second inner arc of the fixed scroll, there is a possibility that the compressed gas refrigerant flows back through the gap and thereby the compression ratio of the gas refrigerant decrease.

Therefore, the development of the scroll compressor, that can prevent the compressed gas refrigerant from flowing back when the compression chamber communicates with the discharge port, and that can increase the compression ratio of the gas refrigerant.

CITATION LIST

Patent Literature

PTL 1: Japanese Unexamined Patent Application Publication No. 2007-315172A

SUMMARY OF THE INVENTION

It is an objective of the present inventions to provide a scroll compressor that can prevent the compressed gas from flowing back when the compression chamber communicates with the discharge port, and that can increase the compression ratio of the gas refrigerant.

In order to achieve the above objective, an embodiment of the present invention provides a scroll compressor comprising: a sealed container; a motor element housed in the sealed container; a scroll compression element housed in the sealed container and configured to be driven by a shaft of the motor element; a suction pipe mounted penetratingly to the sealed container, in which the gas refrigerant sucked from outside flows into the scroll compression element, wherein the scroll compression element including a fixed scroll in which a spiral fixed scroll wrap is stood on a fixed scroll end plate, and an orbiting scroll in which a spiral orbiting scroll wrap is stood on an orbiting scroll end plate, the orbiting scroll wrap configured to be engaged with the fixed scroll wrap to form a first compression chamber with an inner wall of the fixed scroll wrap and an outer wall of the orbiting scroll wrap as well as a second compression chamber with an outer wall of the fixed scroll wrap and an inner wall of the orbiting scroll wrap, the orbiting scroll being configured to orbit opposed to the fixed scroll, and a discharge port formed in the fixed scroll to discharge the gas refrigerant which is compressed in the scroll compression element.

Moreover, in the embodiment of the present invention, a fixed scroll winding start portion of the fixed scroll wrap includes a first fixed scroll outer arc smoothly connecting the tip of the fixed scroll wrap to a winding start point of an involute curve on the outer wall of the fixed scroll wrap, a second fixed scroll inner arc smoothly contacting with a winding start point of an involute curve on the inner wall of the fixed scroll wrap, and a third fixed scroll inner arc which is not smoothly connected to the first fixed scroll outer arc and the second fixed scroll inner arc as well as which is formed to connect the first fixed scroll outer arc and the second fixed scroll inner arc. An orbiting scroll winding start portion of the orbiting scroll wrap includes a first orbiting scroll outer arc smoothly connecting the tip of the orbiting scroll wrap to a winding start point of an involute curve on the outer wall of the orbiting scroll wrap, and a second orbiting scroll inner arc smoothly contacting with a winding start point of an involute curve on the inner wall of the orbiting scroll wrap.

Furthermore, the orbiting scroll orbits while the first orbiting scroll outer arc contacts with the second fixed scroll inner arc, and then when the first orbiting scroll outer arc is not brought into contact with a connection point between the second fixed scroll inner arc and the third fixed scroll inner arc, the first compression chamber communicates with the discharge port.

The compression ratio obtained by dividing the discharge pressure by the suction pressure of the gas refrigerant depends on the shapes of the fixed scroll wrap and the orbiting scroll wrap.

According to the embodiment of the present invention, the orbiting scroll wrap is configured to be engaged with the fixed scroll wrap to form a first compression chamber with an inner wall of the fixed scroll wrap and an outer wall of the orbiting scroll wrap as well as a second compression chamber with an outer wall of the fixed scroll wrap and an inner wall of the orbiting scroll wrap.

As such, the compression ratio can increase due to the volume change of the first compression chamber and the second compression chamber in response to the motion of the orbiting scroll, before the period in which the gas refrigerant is discharged from the discharge port.

Moreover, the orbiting scroll orbits while the first orbiting scroll outer arc contacts with the second fixed scroll inner arc, and then when the first orbiting scroll outer arc is not brought into contact with a connection point between the second fixed scroll inner arc and the third fixed scroll inner arc, the first compression chamber communicates with the discharge port.

As such, it is possible to prevent the compressed gas refrigerant from flowing back between the first orbiting scroll outer arc and the second fixed scroll inner arc when the first compression chamber communicates with the discharge port. Moreover, it is possible to increase the compression ratio of the gas refrigerant since the compressed gas refrigerant is prevented from flowing back.

Therefore, according to the embodiment of the scroll compressor of the present invention, it is possible to prevent the compressed gas refrigerant from flowing back when the first compression chamber communicates with the discharge port, and to increase the compression ratio of the gas refrigerant.

BRIEF DESCRIPTION OF DRAWINGS

The principle of the present invention and its advantages will become apparent in the following description taking in consideration with the accompanying drawings in which:

FIG. 4A to FIG. 4L are diagrams illustrating the first compression chamber 30 and the relative motion of a fixed scroll wrap and an orbiting scroll wrap 62 for one cycle; and FIG. 5A to FIG. 5L are diagrams illustrating the second compression chamber 40 and the relative motion of the fixed scroll wrap and the orbiting scroll wrap 62 for one cycle.

DETAILED DESCRIPTION OF EMBODIMENTS OF THE INVENTION

Hereinafter, an embodiment of the present invention will be described in detail with reference to the drawings.

Figure 1:
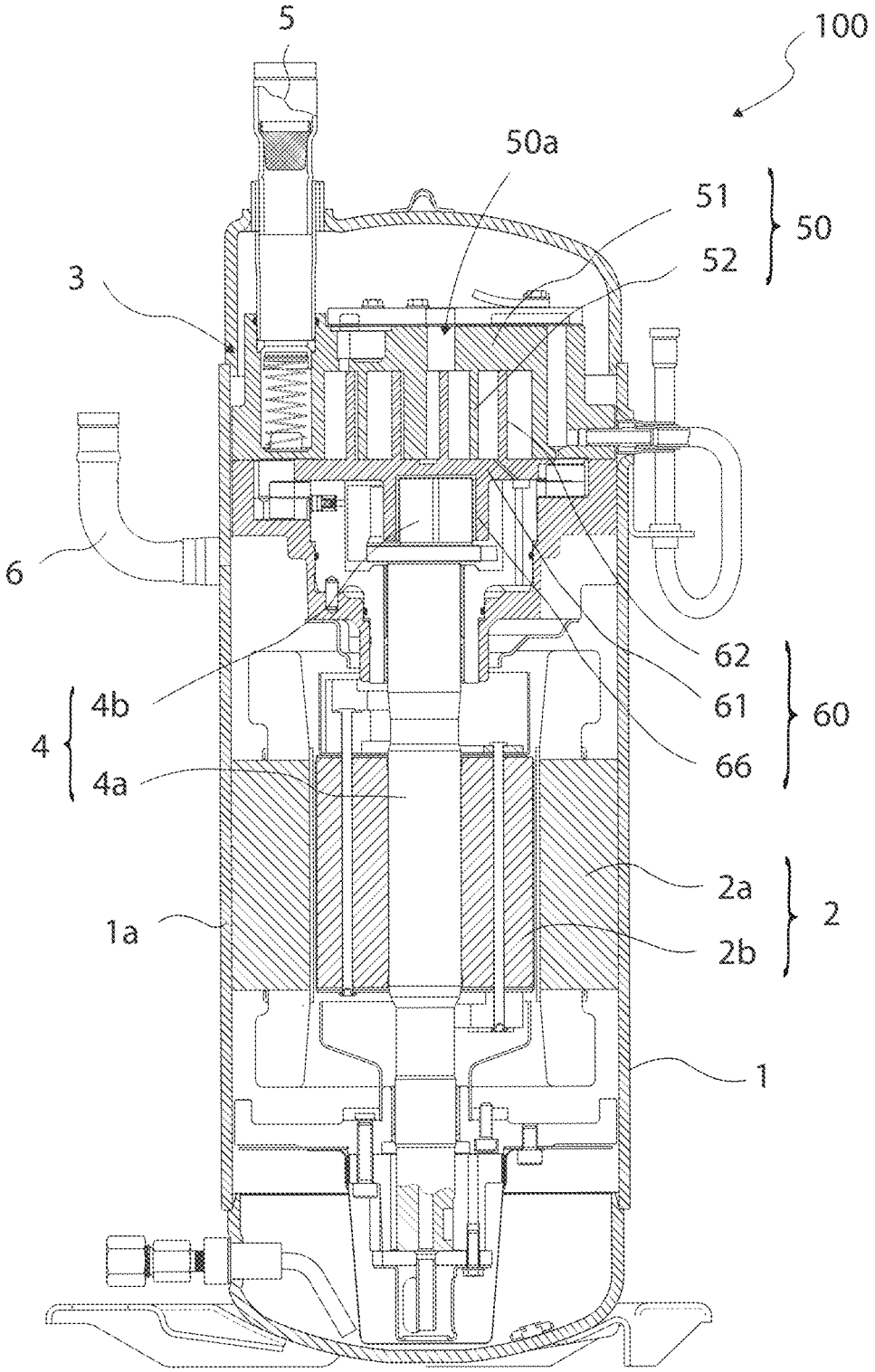
FIG. 1 is a longitudinal section view illustrating a schematic configuration of a scroll compressor 100 according to the embodiment of this invention.

FIG. 1 is a schematic longitudinal sectional view of a scroll compressor 100 according to an embodiment. The scroll compressor 100 is a fluid machine configured to compress and discharge a fluid (i.e., gas refrigerant), and can be a component of a refrigeration cycle apparatus. The scroll compressor 100 according to the embodiment is a vertically-mounted shell compressor.

As shown in FIG. 1, the scroll compressor 100 includes a sealed container 1, a suction pipe 5 mounted penetratingly to a top surface of the sealed container 1 and formed as a hollow cylindrical pipe, a discharge pipe 6 discharging the gas refrigerant to the outside, a scroll compression element 3 configured to compress a low-pressure gas refrigerant in a first compression chamber 30 and a second compression chamber 40, a motor element 2 configured to drive the scroll compression element 3 which is housed in the sealed container 1, and a shaft 4 including a main portion 4*a* and an eccentric portion 4*b* that is eccentric to the main portion 4*a*.

The upper portion of the scroll compression element 3 is supported by a middle shell 1*a* of the sealed container 1. The scroll compression element 3 is fixed to the middle shell 1*a* of the sealed container 1 through shrink fit or other methods. A sub-frame 7 is provided below the motor element 2. The sub-frame 7 is fixed to the inner circumferential surface of the sealed container 1.

The suction pipe 5 configured to suck a low-pressure gas refrigerant into the scroll compression element 3 from outside is connected to a side surface of the sealed container 1. The discharge pipe 6 configured to discharge a high-pressure gas refrigerant to the outside of the scroll compressor 100 is connected to the side face of the sealed container 1.

The scroll compression element 3 is accommodated in the sealed container 1 and configured to compress the gas refrigerant sucked from the suction pipe 5 through rotation of a shaft 4 that is driven by the motor element 2. As shown in FIG. 1, the scroll compression element 3 includes a fixed scroll 50 and an orbiting scroll 60.

Moreover, a discharge port 50*a* configured to discharge the compressed gas refrigerant is formed in a central part of the fixed scroll 50 in the scroll compression element 3.

Figure 2:
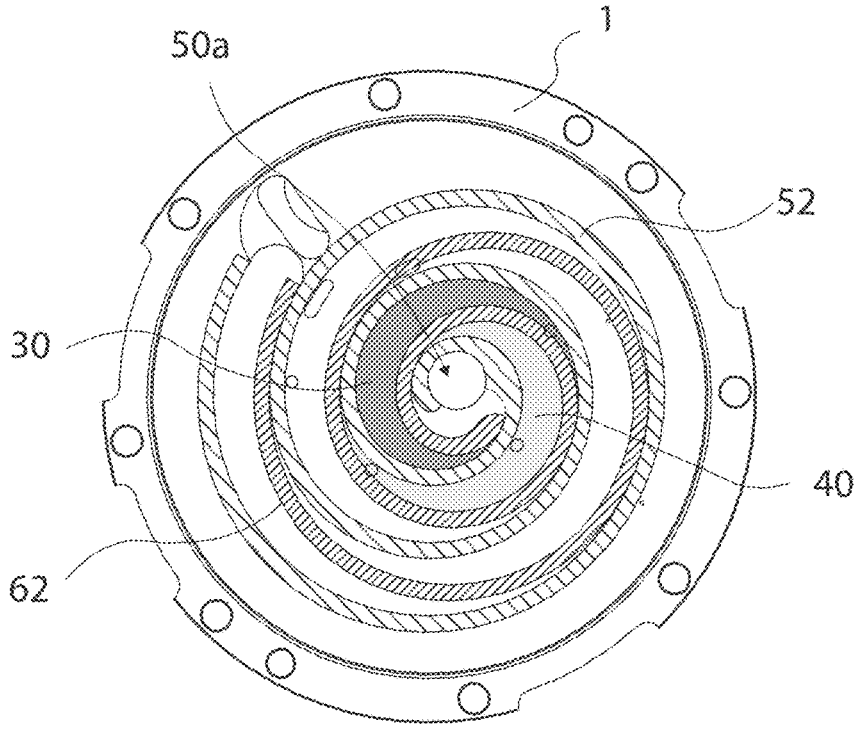
FIG. 2 is an explanation view of a fixed scroll 50 and an orbiting scroll 60 of FIG. 1.

As shown in FIG. 1 and FIG. 2, the fixed scroll 50 is fixed to the middle shell 1*a* at a lower end portion of the fixed scroll 50. The fixed scroll 50 includes a fixed scroll end plate 51 and a spiral fixed scroll wrap 52 that is stood on the fixed scroll end plate 51. The fixed scroll wrap 52 has an involute curve shape so as to form a spiral body and erected on one surface of the fixed scroll end plate 51.

Figure 3A:
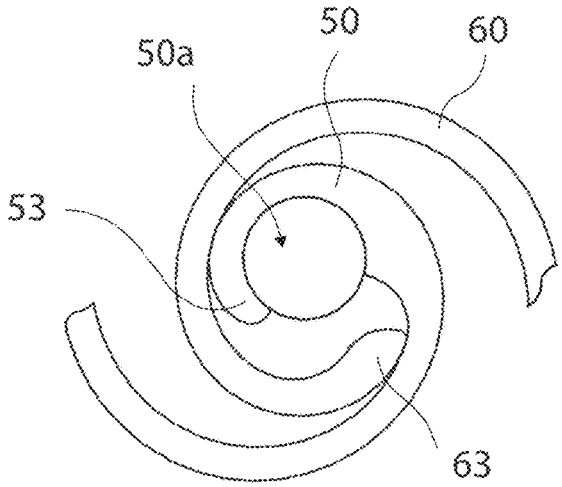
FIG. 3A to FIG. 3C are enlarged view of a fixed scroll winding start portion 53 of FIG. 2 and an orbiting scroll winding start portion 63 of FIG. 2.
Figure 3B:
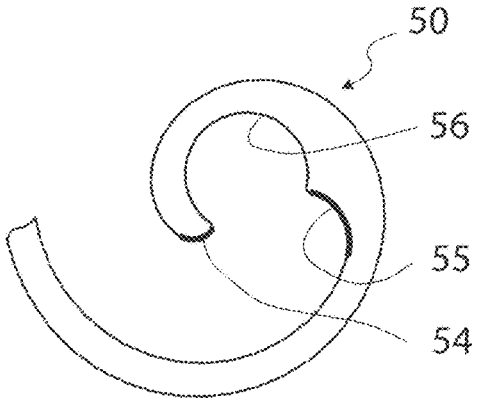

As shown in FIG. 3A and FIG. 3B, a fixed scroll winding start portion 53 of the fixed scroll wrap 52 includes a first fixed scroll outer arc 54 smoothly connecting the tip of the fixed scroll wrap 52 to a winding start point of an involute curve on the outer wall of the fixed scroll wrap 52, a second fixed scroll inner arc 55 smoothly contacting with a winding start point of an involute curve on the inner wall of the fixed scroll wrap 52, and a third fixed scroll inner arc 56 which is not smoothly connected to the first fixed scroll outer arc 54 and the second fixed scroll inner arc 52 as well as which is formed to connect the first fixed scroll outer arc 54 and the second fixed scroll inner arc 55.

As shown in FIG. 1 and FIG. 2, the orbiting scroll 60 is configured to orbit opposed to the fixed scroll 50 without rotating. The orbiting scroll 60 includes an orbiting scroll end plate 61 and a spiral orbiting scroll wrap 62 that is stood on the orbiting scroll end plate 61. The orbiting scroll wrap 62 has an involute curve shape so as to form a spiral body and erected on one surface of the orbiting scroll end plate 61.

Figure 3C:
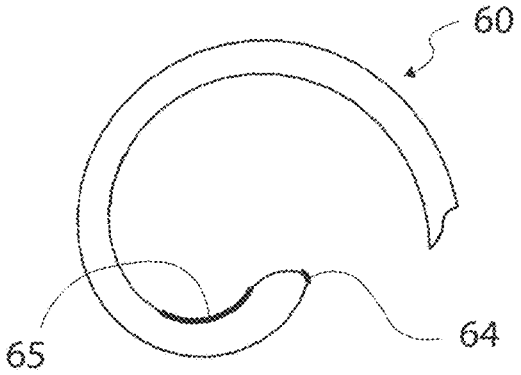

As shown in FIG. 3A and FIG. 3C, an orbiting scroll winding start portion 63 of the orbiting scroll wrap 62 includes a first orbiting scroll outer arc 64 smoothly connecting the tip of the orbiting scroll wrap 62 to a winding start point of an involute curve on the outer wall of the orbiting scroll wrap 62, and a second orbiting scroll inner arc 65 smoothly contacting with a winding start point of an involute curve on the inner wall of the orbiting scroll wrap 62.

Moreover, the orbiting scroll 60 is configured to orbit while the first orbiting scroll outer arc 64 contacts with the second fixed scroll inner arc 55. As such, when a curvature radius of the second fixed scroll inner arc 55 is set to "R2F", and a curvature radius of the first orbiting scroll outer arc 64 is set to "R1O", and an eccentric radius of the eccentric portion 4*b* of the shaft 4 is set to "ER", the following formula is satisfied between the second fixed scroll inner arc 55, the first orbiting scroll outer arc 64, and the eccentric portion 4*b* of the shaft 4.

$$R2F = R1O + ER$$

Namely, the curvature radius R2F of the second fixed scroll inner arc 55 is the same as a curvature radius R1O of the first orbiting scroll outer arc 64 plus an eccentric radius ER of the eccentric portion 4*b* of the shaft 4.

Furthermore, the orbiting scroll 60 is configured to orbit while the second orbiting scroll inner arc 65 contacts with the first fixed scroll outer arc 54. As such, when a curvature radius of the first fixed scroll outer arc 54 plus is set to "R1F", and a curvature radius of the second orbiting scroll inner arc 65 is set to "R2O", and the eccentric radius of the eccentric portion 4*b* of the shaft 4 is set to "ER", the following formula is satisfied between the first fixed scroll outer arc 54, the second orbiting scroll inner arc 65, and the eccentric portion 4*b* of the shaft 4.

$$R2O = R1F + ER$$

Namely, the curvature radius R2O of the second orbiting scroll inner arc 65 is the same as a curvature radius R1F of the first fixed scroll outer arc 54 plus an eccentric radius ER of the eccentric portion 4*b* of the shaft 4.

In addition, the curvature radius R1O of the first orbiting scroll outer arc 64 and the curvature radius R1F of the first fixed scroll outer arc 54 are preferably from 1 mm to 5 mm.

An orbiting bearing 66 formed in a bottomed cylindrical shape is formed in a substantially central part on an undersurface of the orbiting scroll end plate 61. The eccentric portion 4*b* that is eccentric to the main portion 4*a* of the shaft 4, is installed on an upper end of the main portion 4*a* of the shaft 4. The eccentric portion 4*b* is inserted in the orbiting bearing 66, in order to cause the orbiting scroll 60 to orbit.

As shown in FIG. 2, the orbiting scroll wrap 62 is configured to be engaged with the fixed scroll wrap 52 to form the first compression chamber 30 with an inner wall of the fixed scroll wrap 52 and an outer wall of the orbiting scroll wrap 62 as well as the second compression chamber 40 with an outer wall of the fixed scroll wrap 52 and an inner wall of the orbiting scroll wrap 62.

As shown in FIG. 1, the motor element 2 includes an electric motor stator 2*a* fixed to the inner circumferential surface of the sealed container 1 through shrink fit or other methods, an electric motor rotor 2*b* rotatably housed on an inner circumferential side of the electric motor stator 2*a*, and the main portion 4*a* of the shaft 4 fixed to the electric motor rotor 2*b*. The electric motor rotor 2*b* is configured to rotate as electric power is supplied to the electric motor stator 2*a* and to transmit a driving force to the orbiting scroll 60 through the shaft 4.

Next, a description will be given of the relationship between the movement of the orbiting scroll 60 relative to the fixed scroll 50 and shape changes of the first and second compression chambers 30, 40 when the scroll compressor 100 is operated.

FIG. 4A to FIG. 4L are diagrams illustrating the first compression chamber 30 and the relative motion of the fixed scroll wrap 52 and the orbiting scroll wrap 62 for one cycle, when a time at which the first orbiting scroll outer arc 64 contacts with the second fixed scroll inner arc 55 in the first compression chamber 30 for the first time is defined as a first revolution angle A1 of the orbiting scroll 60 being 0 degree. In this embodiment, the first orbiting scroll outer arc 64 does not contact with the second fixed scroll inner arc 55 in the first compression chamber 30 when the first revolution angle A1 exceeds a first predetermined angle A11.

Firstly, as shown in FIG. 4A, the first orbiting scroll outer arc 64 contacts with the second fixed scroll inner arc 55. Since the second fixed scroll inner arc 55 is formed smoothly to contacting with the winding start point of an involute curve on the inner wall of the fixed scroll wrap 52, the first orbiting scroll outer arc 64 smoothly contacts with the second fixed scroll inner arc 55.

Secondly, as shown in FIG. 4B to FIG. 4D, the orbiting scroll 60 orbits while the first orbiting scroll outer arc 64 contacts with the second fixed scroll inner arc 55, and then the first orbiting scroll outer arc 64 contacts with a connection point between the second fixed scroll inner arc 55 and the third fixed scroll inner arc 56.

Thirdly, as shown in FIG. 4E, the first compression chamber 30 communicates with the discharge port 50*a* after the connection point between the second fixed scroll inner arc 55 and the third fixed scroll inner arc 56 contacts with the first orbiting scroll outer arc 64.

Namely, when the first orbiting scroll outer arc 64 is not brought into contact with a connection point between the second fixed scroll inner arc 55 and the third fixed scroll inner arc 56, the first compression chamber 30 communicates with the discharge port 50*a*. In other words, when the first revolution angle A1 exceeds the first predetermined angle A11, the first compression chamber 30 communicates with the discharge port 50*a* during the first revolution angle A1 exceeds the first predetermined angle A11.

In addition, in this embodiment, as can be seen from FIG. 4D and FIG. 4E, the first compression chamber 30 communicates with the discharge port 50*a* while the first revolution angle A1 exceeds the first predetermined angle A11 which is between 90 and 120 degrees.

Finally, the orbiting scroll 60 continues to orbit and the compressed gas refrigerant is discharged from the discharge port 50*a*.

As such, it is possible to prevent the compressed gas refrigerant from flowing back between the first orbiting scroll outer arc 64 and the second fixed scroll inner arc 55 when the first compression chamber 30 communicates with the discharge port 50*a*. Moreover, it is possible to increase the compression ratio of the gas refrigerant since the compressed gas refrigerant is prevented from flowing back.

Moreover, FIG. 5A to FIG. 5L are diagrams illustrating the second compression chamber 40 and the relative motion of the fixed scroll wrap 52 and the orbiting scroll wrap 62 for one cycle, when a time at which the second orbiting scroll inner arc 65 contacts with the first fixed scroll outer arc 54 in the second compression chamber 40 for the first time is defined as a second revolution angle A2 of the orbiting scroll 60 being 0 degree. In this embodiment, the second orbiting scroll inner arc 65 does not contact with the first fixed scroll outer arc 54 in the second compression chamber 40 when the second revolution angle A2 exceeds a second predetermined angle A21.

Firstly, as shown in FIG. 5A, the second orbiting scroll inner arc 65 contacts with the first fixed scroll outer arc 54. Since the second orbiting scroll inner arc 65 is formed smoothly to contacting with the winding start point of an involute curve on the inner wall of the orbiting scroll wrap 62, the second orbiting scroll inner arc 65 smoothly contacts with the first fixed scroll outer arc 54.

Secondly, as shown in FIG. 5B to FIG. 5D, the orbiting scroll 60 orbits while the second orbiting scroll inner arc 65 contacts with the first fixed scroll outer arc 54.

Thirdly, as shown in FIG. 5E, the second compression chamber 40 communicates with the discharge port 50*a* after the first fixed scroll outer arc 54 contacts the second orbiting scroll inner arc 65.

Namely, when the first fixed scroll outer arc 54 contacts the second orbiting scroll inner arc 65, the second compression chamber 40 communicates with the discharge port 50*a*. In other words, when the second revolution angle A2 exceeds the second predetermined angle A21, the second compression chamber 40 communicates with the discharge port 50*a* during the second revolution angle A2 exceeds the second predetermined angle A21.

In addition, in this embodiment, as can be seen from FIG. 5D and FIG. 5E, the second compression chamber 40 communicates with the discharge port 50*a* while the second revolution angle A2 exceeds the second predetermined angle 21 which is between 90 and 120 degrees.

Finally, the orbiting scroll 60 continues to orbit and the compressed gas refrigerant is discharged from the discharge port 50*a*.

As such, it is possible to prevent the compressed gas refrigerant from flowing back between the second orbiting scroll inner arc 65 and the first fixed scroll outer arc 54 when the second compression chamber 40 communicates with the discharge port 50*a*. Moreover, it is possible to increase the compression ratio of the gas refrigerant since the compressed gas refrigerant is prevented from flowing back.

Therefore, according to the embodiment of the scroll compressor 100, it is possible to prevent the compressed gas refrigerant from flowing back when the first compression chamber 30 and the second compression chamber 40 communicates with the discharge port 50*a*, and to increase the compression ratio of the gas refrigerant.

In addition, in this embodiment, the first predetermined angle A11 is between 90 and 120 degrees (FIG. 4D, FIG. 4E), but not limited to this. The maximum angle of the first predetermined angle A11 is 180 degree. Moreover, the second predetermined angle A21 is between 90 and 120 degrees (FIG. 5D, FIG. 5E), but not limited to this. The maximum angle of the second predetermined angle A21 is 180 degree.

Although specific embodiments of the invention have been disclosed and described as well as illustrated in the companying drawings, it is simply for the purpose of better understanding of the principle of the present invention, and it is not as a limitation of the scope and spirit of the teaching of the present invention. Adaption and modification to various structures such as design or material of the invention are possible and apparent to a skilled person without departing from the scope of the present invention which is to be determined by the claims.

LIST OF REFERENCES

100: scroll compressor
1: sealed container
1*a*: middle shell
2: motor element
2*a*: electric motor stator
2*b*: electric motor rotor
3: scroll compression element
4: shaft
4*a*: main portion
4*b*: eccentric portion
5: suction pipe
6: discharge pipe
7: sub-frame
30: first compression chamber
40: second compression chamber
50: fixed scroll
50*a*: discharge port
51: fixed scroll end plate
52: fixed scroll wrap
53: fixed scroll winding start portion
54: first fixed scroll outer arc
55: second fixed scroll inner arc
56: third fixed scroll inner arc
60: orbiting scroll
61: orbiting scroll end plate
62: orbiting scroll wrap
63: orbiting scroll winding start portion
64: first orbiting scroll outer arc
65: second orbiting scroll inner arc
66: orbiting bearing
R1F: curvature radius of the first fixed scroll outer arc 54
R2F: curvature radius of the second fixed scroll inner arc 55
R1O: curvature radius of the first orbiting scroll outer arc 64
R2O: curvature radius of the second orbiting scroll inner arc 65
ER: eccentric radius of the eccentric portion 4*b* of the shaft 4
A1: first revolution angle
A2: second revolution angle

The invention claimed is:

1. A scroll compressor comprising:

a sealed container;

a motor element housed in the sealed container;

a scroll compression element housed in the sealed container and configured to be driven by a shaft of the motor element;

a suction pipe mounted penetratingly to the sealed container, in which the gas refrigerant sucked from outside flows into the scroll compression element, wherein the scroll compression element including a fixed scroll in which a spiral fixed scroll wrap is stood on a fixed scroll end plate, and an orbiting scroll in which a spiral orbiting scroll wrap is stood on an orbiting scroll end plate, the orbiting scroll wrap configured to be engaged with the fixed scroll wrap to form a first compression chamber with an inner wall of the fixed scroll wrap and an outer wall of the orbiting scroll wrap as well as a second compression chamber with an outer wall of the fixed scroll wrap and an inner wall of the orbiting scroll wrap, the orbiting scroll being configured to orbit opposed to the fixed scroll, and a discharge port formed in the fixed scroll to discharge the gas refrigerant which is compressed in the scroll compression element, wherein a fixed scroll winding start portion of the fixed scroll wrap includes a first fixed scroll outer arc smoothly connecting the tip of the fixed scroll wrap to a winding start point of an involute curve on the outer wall of the fixed scroll wrap, a second fixed scroll inner arc smoothly contacting with a winding start point of an involute curve on the inner wall of the fixed scroll wrap, and a third fixed scroll inner arc which is not smoothly connected to the first fixed scroll outer arc and the second fixed scroll inner arc as well as which is formed to connect the first fixed scroll outer arc and the second fixed scroll inner arc, wherein an orbiting scroll winding start portion of the orbiting scroll wrap includes a first orbiting scroll outer arc smoothly connecting the tip of the orbiting scroll wrap to a winding start point of an involute curve on the outer wall of the orbiting scroll wrap, and a second orbiting scroll inner arc smoothly contacting with a winding start point of an involute curve on the inner wall of the orbiting scroll wrap, and wherein the orbiting scroll orbits while the first orbiting scroll outer arc contacts with the second fixed scroll inner arc, and then when the first orbiting scroll outer arc is not brought into contact with a connection point between the second fixed scroll inner arc and the third fixed scroll inner arc, the first compression chamber communicates with the discharge port, wherein the orbiting scroll orbits while the second orbiting scroll inner arc contacts with the first fixed scroll outer arc, and then when the first fixed scroll outer arc contacts the second orbiting scroll inner arc, the second compression chamber communicates with the discharge port, and wherein in case that a time at which the first orbiting scroll outer arc contacts with the second fixed scroll inner arc in the first compression chamber for the first time is defined as a first revolution angle of the orbiting scroll being 0 degrees as well as in case that the first orbiting scroll outer arc does not contact with the second fixed scroll inner arc in the first compression chamber when the first revolution angle exceeds a first predetermined angle, the first compression chamber communicates with the discharge port during the first revolution angle exceeds the first predetermined angle.

2. The scroll compressor of claim 1, wherein the maximum angle of the first predetermined angle is 180 degrees.

3. The scroll compressor of claim 1, wherein in case that a time at which the second orbiting scroll inner arc contacts with the first fixed scroll outer arc in the second compression chamber for the first time is defined as a second revolution angle of the orbiting scroll being 0 degrees as well as in case that the second orbiting scroll inner arc does not contact with the first fixed scroll outer arc in the second compression chamber when the second revolution angle exceeds a second predetermined angle, the second compression chamber communicates with the discharge port during the second revolution angle exceeds the second predetermined angle.

4. The scroll compressor of claim 1, wherein the maximum angle of the second predetermined angle is 180 degrees.

5. The scroll compressor of claim 1, wherein a curvature radius of the second fixed scroll inner arc is the same as a curvature radius of the first orbiting scroll outer arc plus an eccentric radius of an eccentric portion of the shaft.

6. The scroll compressor of claim 1, wherein a curvature radius of the second orbiting scroll inner arc is the same as a curvature radius of the first fixed scroll outer arc plus an eccentric radius of an eccentric portion of the shaft.

7. The scroll compressor of claim 1, wherein a curvature radius of the first orbiting scroll outer arc and a curvature radius of the first fixed scroll outer arc are from 1 mm to 5 mm.

8. The scroll compressor of claim 1, wherein the third fixed scroll inner arc forms a part of the discharge port.

* * * * *